US008492962B2

(12) United States Patent
Shibata et al.

(10) Patent No.: US 8,492,962 B2
(45) Date of Patent: Jul. 23, 2013

(54) SPARK PLUG FOR INTERNAL COMBUSTION ENGINE

(75) Inventors: Tsutomu Shibata, Owariasahi (JP); Keita Nakagawa, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 61 days.

(21) Appl. No.: 13/140,099

(22) PCT Filed: Dec. 24, 2009

(86) PCT No.: PCT/JP2009/071384

§ 371 (c)(1), (2), (4) Date: Jun. 16, 2011

(87) PCT Pub. No.: WO2010/074115

PCT Pub. Date: Jul. 1, 2010

(65) Prior Publication Data

US 2011/0248620 A1 Oct. 13, 2011

(30) Foreign Application Priority Data

Dec. 24, 2008 (JP) ..... 2008-327199

(51) Int. Cl.

| | |
|---|---|
| ***F02M 57/06*** | (2006.01) |
| ***F02P 13/00*** | (2006.01) |
| ***H01T 13/00*** | (2006.01) |
| ***H01T 13/20*** | (2006.01) |

(52) U.S. Cl.
USPC ..... 313/118; 313/137

(58) Field of Classification Search
USPC ..... 313/118–145
See application file for complete search history.

(56) References Cited

U.S. PATENT DOCUMENTS

| | | | | |
|---|---|---|---|---|
| 4,601,848 | A * | 7/1986 | Sakai et al. | 252/503 |
| 6,160,342 | A | 12/2000 | Nishikawa et al. | |
| 6,334,800 | B1 | 1/2002 | Nishikawa et al. | |

FOREIGN PATENT DOCUMENTS

| | | | |
|---|---|---|---|
| JP | 52-042512 | | 4/1977 |
| JP | 55-149289 | U | 10/1980 |
| JP | 03-269908 | A | 12/1991 |
| JP | 09-306636 | A | 11/1997 |
| JP | 11-228156 | A | 8/1999 |
| JP | 11-233232 | A | 8/1999 |
| JP | 2005-327743 | A | 11/2005 |
| JP | 2006-236906 | A | 9/2006 |

OTHER PUBLICATIONS

Office Action of the corresponding Japanese Application No. 2010-519042 mailed Aug. 16, 2012.
International Search Report mailed Mar. 30, 2010 for the corresponding PCT application No. PCT/JP2009/071384.
Office Action mailed Nov. 21, 2012 for the corresponding Chinese Patent Application No. 200980144251.4.

* cited by examiner

*Primary Examiner* — Anh Mai
*Assistant Examiner* — Zachary J Snyder
(74) *Attorney, Agent, or Firm* — Leason Ellis LLP.

(57) ABSTRACT

Provided is a spark plug which allows a predetermined resistance to be imparted to a resistor with restraint of variation in resistance of the resistor and in turn, enables enhancement of yield. The spark plug includes a ceramic insulator having an axial hole extending in the direction of an axis CL1, a center electrode, and a terminal electrode. A resistor is provided in the axial hole through sintering of a resistor composition which contains a conductive material such as carbon black, glass powder, and ceramic particles other than glass. As viewed on a section of the resistor taken along a direction orthogonal to the axis CL1, 50% or more of sintered glass powder formed through sintering of the glass powder has a circularity of 0.8 or greater.

11 Claims, 4 Drawing Sheets

SPARK PLUG FOR INTERNAL COMBUSTION ENGINE

CROSS-REFERENCE TO RELATED PATENT APPLICATIONS

This application is a U.S. National Phase Application under 35 U.S.C.§371 of International Patent Application No. PCT/JP2009/071384, filed Dec. 24, 2009, and claims the benefit of Japanese Patent Application No. 2008-327199, filed Dec. 24, 2008, all of which are incorporated by reference herein. The International Application was published in Japanese on Jul. 1, 2010 as International Publication No. WO/2010/074115 under PCT Article 21(2).

FIELD OF THE INVENTION

The present invention relates to a spark plug for use in an internal combustion engine.

BACKGROUND OF THE INVENTION

A spark plug for an internal combustion engine is mounted to an internal combustion engine and is used to ignite air-fuel mixture in a combustion chamber. Generally, a spark plug includes an insulator having an axial hole, a center electrode inserted into a front end portion of the axial hole, a terminal electrode inserted into a rear end portion of the axial hole, a metallic shell provided externally of the outer circumference of the insulator, and a ground electrode provided on the front end surface of the metallic shell and forming a spark discharge gap in cooperation with the center electrode. A resistor is provided in the axial hole between the center electrode and the terminal electrode and is adapted for restraining radio noise generated in association with operation of the engine. The center electrode and the ground electrode are electrically connected to each other via the resistor (refer to, for example, Japanese Patent Application Laid-Open (kokai) No. 9-306636).

The resistor is formed through compression and sintering of a resistor composition disposed between the center electrode and the terminal electrode. The resistor composition predominantly contains a conductive material, glass powder, and ceramic particles. In the resistor, the conductive material is disposed in such a manner as to cover the surfaces of particles of glass powder and the surfaces of ceramic particles; as a result, the conductive material forms a large number of conductive paths which electrically connect the two electrodes. A crushed powder of glass is generally used as the glass powder mentioned above.

Meanwhile, in recent years, the operation of an internal combustion engine is controlled in a complicated manner by use of a computer. Thus, in order to more reliably prevent the occurrence of a malfunction of the computer or a like problem, the resistor is required to provide an enhanced effect of restraining radio noise. For enhancement of the effect of restraining radio noise, increasing the resistance of the resistor is effective. However, increasing the resistance is accompanied by a reduction in energy required for spark discharge, potentially resulting in deterioration in ignition performance. Therefore, in order to restrain, to the greatest possible extent, deterioration in energy required for spark discharge while exhibiting a sufficient effect of restraining radio noise, the resistor must have a resistance that falls within a certain relatively narrow range.

However, in the case of using a crushed powder of glass as the glass powder as mentioned above, particles of the crushed powder have greatly different shapes. Accordingly, the arrangement of particles of the glass powder (sintered glass powder) in the resistor formed through sintering may vary greatly among manufactured spark plugs. Therefore, the quantity, thickness, length, etc., of conductive paths formed between particles of the sintered glass powder vary to a relatively great extent, and in turn, the resistance of the resistor may vary greatly among manufactured spark plugs. That is, using the above-mentioned technique encounters great difficulty in more accurately imparting a predetermined resistance to the resistor with restraint of variation in resistance of the resistor. Therefore, in manufacture of spark plugs whose resistance of the resistor falls within a relatively narrow range as mentioned above, yield may deteriorate.

The present invention has been conceived in view of the above circumstances, and an object of the invention is to provide a spark plug for an internal combustion engine which allows a predetermined resistance to be more accurately imparted to a resistor with restraint of variation in resistance of the resistor and in turn, enables enhancement of yield.

SUMMARY OF THE INVENTION

Configurations suitable for achieving the above object will next be described in itemized form. If needed, actions and effects peculiar to the configurations will be additionally described.

Configuration 1. A spark plug for an internal combustion engine of the present configuration comprises a substantially tubular insulator having an axial hole extending therethrough in a direction of an axis; a center electrode inserted into one end portion of the axial hole; a terminal electrode inserted into the other end portion of the axial hole; a substantially tubular metallic shell provided externally of an outer circumference of the insulator; and a resistor formed in the axial hole through sintering of a resistor composition containing a conductive material, glass powder, and ceramic particles other than glass, and electrically connecting the center electrode and the terminal electrode. The spark plug is characterized in that, as viewed on a section of the resistor taken along a direction orthogonal to the axis, 50% or more of sintered glass powder formed through sintering of the glass powder has a circularity of 0.8 or greater.

The term "circularity" means a value obtained by dividing the circumference of a circle whose area is equal to the area of a cross section of a particle of the sintered glass powder by the perimeter of the cross section of the particle of the sintered glass powder. Therefore, the closer to 1 the circularity, the more closely the shape of a particle of the sintered glass powder approximates a sphere.

According to configuration 1 mentioned above, as viewed on a section of the resistor taken along a direction orthogonal to the axis, 50% or more of the sintered glass powder has a circularity of 0.8 or greater. Thus, as compared with the case of using a crushed powder of glass as the glass powder, variation in arrangement of particles of the sintered glass powder in the resistor can be lessened. By virtue of this, great variation among plugs in the quantity, thickness, length, etc., of conductive paths formed between particles of the sintered glass powder can be restrained to the greatest possible extent; thus, a predetermined resistance can be more accurately imparted to the resistor with restraint of variation in resistance of the resistor among manufactured spark plugs. As a result, yield can be drastically enhanced.

Configuration 2. A spark plug for an internal combustion engine of the present configuration is characterized in that in configuration 1 mentioned above, the sintered glass powder is formed such that 60% or more thereof has a circularity of 0.8 or greater as viewed on the section of the resistor taken along a direction orthogonal to the axis.

Through employment of configuration 2 mentioned above, a predetermined resistance can be more accurately imparted to the resistor with further restraint of variation in resistance of the resistor.

Configuration 3. A spark plug for an internal combustion engine of the present configuration is characterized in that in configuration 1 or 2 mentioned above, the sintered glass powder contains one glass material selected from the group consisting of $B_2O_3$—$SiO_2$-based, BaO—$B_2O_3$-based, $SiO_2$—$B_2O_3$—BaO-based, and $SiO_2$—ZnO—$B_2O_3$-based glass materials.

As in the case of configuration 3 mentioned above, the sintered glass powder may contain one glass material selected from the group consisting of $B_2O_3$—$SiO_2$-based, BaO—$B_2O_3$-based, $SiO_2$—$B_2O_3$—BaO-based, and $SiO_2$—ZnO—$B_2O_3$-based glass materials. In this case, actions and effects similar to those yielded by configurations mentioned above including configuration 1 are yielded.

Configuration 4. A spark plug for an internal combustion engine of the present configuration comprises a substantially tubular insulator having an axial hole extending therethrough in a direction of an axis; a center electrode inserted into one end portion of the axial hole; a terminal electrode inserted into the other end portion of the axial hole; a substantially tubular metallic shell provided externally of an outer circumference of the insulator; and a resistor formed in the axial hole through sintering of a resistor composition containing a conductive material, glass powder, and ceramic particles other than glass, and electrically connecting the center electrode and the terminal electrode. The resistor contains the conductive material in an amount of 0.5% by mass to 10% by mass inclusive, glass in an amount of 60% by mass to 90% by mass inclusive, and the ceramic particles in an amount of 5% by mass to 30% by mass inclusive. The glass powder has an average particle size of 50 μm to 500 μm inclusive. The spark plug is characterized in that 50% by mass or more of the glass powder contained in the resistor composition is spherical.

The term "spherical" does not necessarily mean that the shape is limited to a sphere in a strict sense. Therefore, the sectional shape of a particle of the glass powder may be somewhat elliptic, elongated circular, teardrop-like, etc. For example, glass powder formed by the technique described in Japanese Patent Application Laid-Open (kokai) No. S52-42512 (a high-speed fluid is blown against molten glass, thereby dispersing glass particles, and the dispersed glass particles assume the form of spherical glass powder by the effect of surface tension) and glass powder formed by the technique described in Japanese Patent Application Laid-Open (kokai) No. H11-228156 (cullet is mixed with abrasive and grinding aid, and the resultant mixture is kneaded, thereby yielding spherical glass powder) can be said to be spherical glass powder.

According to configuration 4 mentioned above, 50% by mass or more of the glass powder contained in the resistor composition is spherical. Thus, similar to the case of configuration 1 mentioned above, great variation among plugs in the quantity, thickness, length, etc., of conductive paths formed between particles of the sintered glass powder can be restrained to the greatest possible extent. As a result, a predetermined resistance can be more accurately imparted to the resistor with restraint of variation in resistance of the resistor; accordingly, yield can be enhanced.

When the average particle size of the glass powder is less than 50 μm, workability may deteriorate in preparing the resistor composition and in charging the resistor composition into the axial hole of the insulator. When the average particle size of the glass powder is in excess of 50 μm, pores are likely to exist between particles of the sintered glass powder of the resistor; accordingly, the resistor may fail to exhibit sufficient under-load life.

Configuration 5. A spark plug for an internal combustion engine of the present configuration is characterized in that in configuration 4 mentioned above, the glass powder is formed such that 80% by mass or more thereof is spherical.

Through employment of configuration 5 mentioned above, variation in resistance of the resistor can be further restrained, so that a predetermined resistance can be imparted more accurately to the resistor.

In view of more accurate impartment of a predetermined resistance to the resistor with restraint of variation in resistance of the resistor, preferably, 90% by mass or more of the glass powder is spherical. Most preferably, 100% of the glass powder is spherical.

Configuration 6. A spark plug for an internal combustion engine of the present configuration is characterized in that in configuration 4 or 5 mentioned above, the glass powder has an average particle size of 50 μm to 200 μm inclusive.

According to configuration 6 mentioned above, the glass powder has an average particle size of 200 μm or less. Thus, formation of pores between particles of the sintered glass powder in the resistor can be effectively restrained. As a result, the resistor can exhibit excellent under-load life.

Configuration 7. A spark plug for an internal combustion engine of the present configuration is characterized in that in any one of configurations 4 to 6 mentioned above, the glass powder contains one glass material selected from the group consisting of $B_2O_3$—$SiO_2$-based, BaO—$B_2O_3$-based, $SiO_2$—$B_2O_3$—BaO-based, and $SiO_2$—ZnO—$B_2O_3$-based glass materials.

As in the case of configuration 7 mentioned above, the glass powder may contain one glass material selected from the group consisting of $B_2O_3$—$SiO_2$-based, BaO—$B_2O_3$-based, $SiO_2$—$B_2O_3$—BaO-based, and $SiO_2$—ZnO—$B_2O$-based glass materials. In this case, actions and effects similar to those yielded by configurations mentioned above including configuration 4 are yielded.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
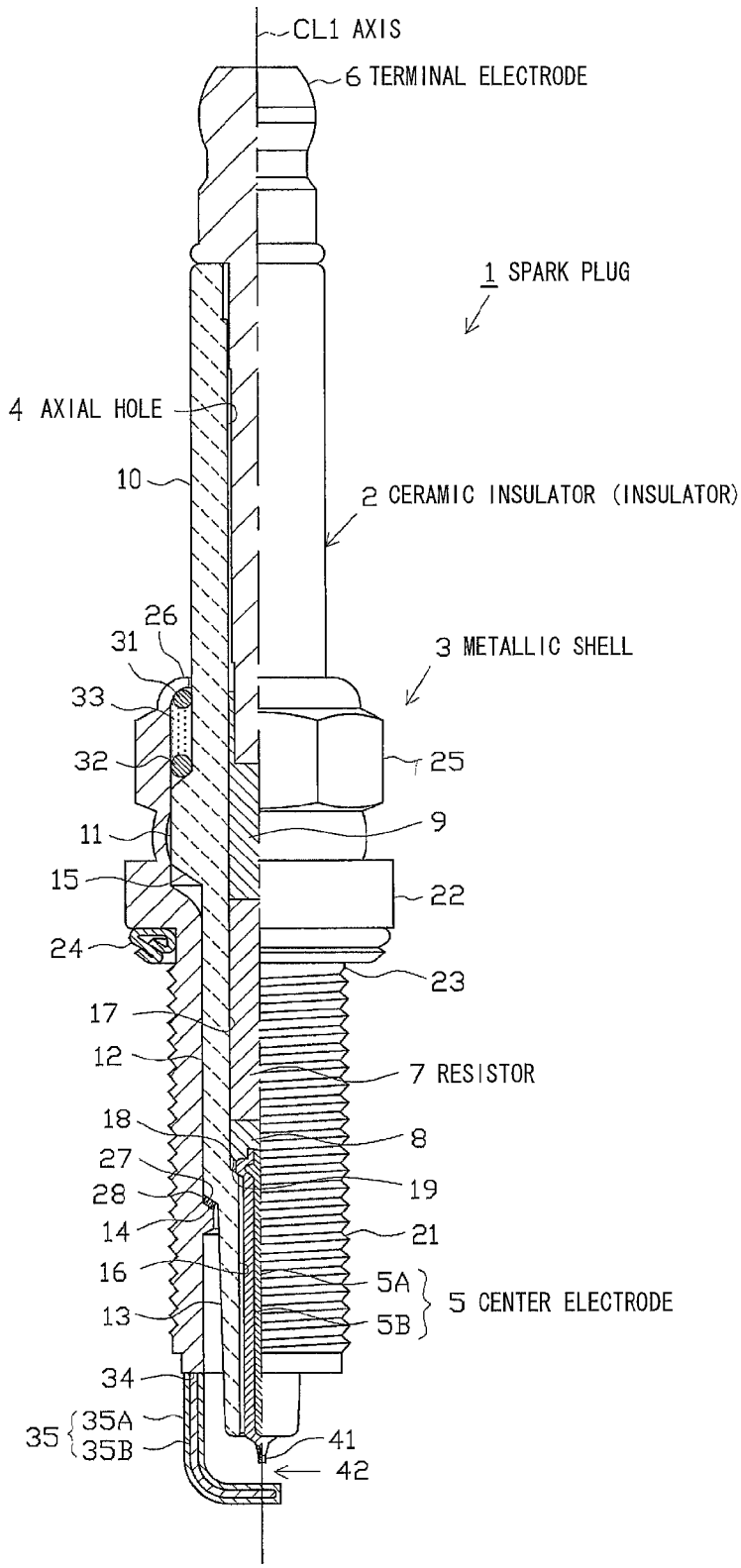
FIG. 1 is a partially cutaway front view showing the configuration of a spark plug according to an embodiment of the present invention.

An embodiment of the present invention will next be described with reference to the drawings. FIG. 1 is a partially cutaway front view showing a spark plug for an internal combustion engine (hereinafter referred to as the "spark plug") 1. In the following description, the direction of an axis CL1 of the spark plug 1 in FIG. 1 is referred to as the vertical direction, and the lower side of the spark plug 1 in FIG. 1 is referred to as the front side of the spark plug 1, and the upper side as the rear side of the spark plug 1.

The spark plug 1 includes a tubular ceramic insulator 2, which serves as an insulator, and a tubular metallic shell 3, which holds the ceramic insulator 2.

The ceramic insulator 2 is formed from alumina or the like by firing, as well known in the art. The ceramic insulator 2 externally includes a rear trunk portion 10 formed on the rear side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. The large-diameter portion 11, the intermediate trunk portion 12, and most of the leg portion 13 are accommodated in the metallic shell 3. A tapered, first stepped portion 14, which is tapered frontward, is formed at a connection portion between the leg portion 13 and the intermediate trunk portion 12. The ceramic insulator 2 is seated on the metallic shell 3 via the stepped portion 14. A tapered, second stepped portion 15, which is tapered frontward, is formed at a connection portion between the intermediate portion 12 and the large-diameter portion 11.

Further, the ceramic insulator 2 has an axial hole 4 extending therethrough along the axis CL1. The axial hole 4 has a small-diameter portion 16 formed at a front end portion thereof, and a large-diameter portion 17, which is located rearward of the small-diameter portion 16 and is greater in diameter than the small-diameter portion 16. A tapered, stepped portion 18 is formed between the small-diameter portion 16 and the large-diameter portion 17.

Additionally, a center electrode 5 is fixedly inserted into a front end portion (small-diameter portion 16) of the axial hole 4. More specifically, the center electrode 5 has an expanded portion 19 formed at a rear end portion thereof and expanding in a direction toward the outer circumference thereof. The center electrode 5 is fixed in a state in which the expanded portion 19 is seated on the stepped portion 18 of the axial hole 4. The center electrode 5 includes an inner layer 5A of copper or a copper alloy, and an outer layer 5B of an Ni alloy which contains nickel (Ni) as a main component. The center electrode 5 assumes a rodlike (circular columnar) shape as a whole; has a flat front end surface; and projects from the front end of the ceramic insulator 2.

Also, a terminal electrode 6 is fixedly inserted into the rear side (large-diameter portion 17) of the axial hole 4 and projects from the rear end of the ceramic insulator 2.

Further, a circular columnar resistor 7 is disposed within the axial hole 4 between the center electrode 5 and the terminal electrode 6. As will be described in detail later, the resistor 7 is formed through compression and sintering of a mixture of carbon black, which serves as a conductive material, glass powder, etc. Additionally, opposite end portions of the resistor 7 are electrically connected to the center electrode 5 and the terminal electrode 6 via conductive glass seal layers 8 and 9, respectively.

Additionally, the metallic shell 3 is formed from a low-carbon steel or the like and is formed into a tubular shape. The metallic shell 3 has a threaded portion (externally threaded portion) 21 on its outer circumferential surface, and the threaded portion 21 is used to mount the spark plug 1 to an engine head. The metallic shell 3 has a seat portion 22 formed on its outer circumferential surface and located rearward of the threaded portion 21. A ring-like gasket 24 is fitted to a screw neck 23 located at the rear end of the threaded portion 21. The metallic shell 3 also has a tool engagement portion 25 provided near its rear end. The tool engagement portion 25 has a hexagonal cross section and allows a tool such as a wrench to be engaged therewith when the metallic shell 3 is to be mounted to the engine head. Further, the metallic shell 3 has a crimp portion 26 provided at its rear end portion and adapted to hold the ceramic insulator 2.

The metallic shell 3 has a tapered metallic-shell stepped portion 27 provided on the front side of its inner circumferential surface and adapted to allow the ceramic insulator 2 to be seated thereon. The ceramic insulator 2 is inserted frontward into the metallic shell 3 from the rear end of the metallic shell 3. In a state in which the first stepped portion 14 of the ceramic insulator 2 butts against the metallic-shell stepped portion 27 of the metallic shell 3, a rear-end opening portion of the metallic shell 3 is crimped radially inward; i.e., the crimp portion 26 is formed, whereby the ceramic insulator 2 is fixed in place. An annular sheet packing 28 intervenes between the first stepped portions 14 and the metallic-shell stepped portion 27. This retains gastightness of a combustion chamber and prevents leakage of an air-fuel mixture to the exterior of the spark plug 1 through a clearance between the inner circumferential surface of the metallic shell 3 and the leg portion 13 of the ceramic insulator 2, which leg portion 13 is exposed to the combustion chamber.

Further, in order to ensure gastightness which is established by crimping, annular ring members 31 and 32 intervene between the metallic shell 3 and the ceramic insulator 2 in a region near the rear end of the metallic shell 3, and a space between the ring members 31 and 32 is filled with a powder of talc 33. That is, the metallic shell 3 holds the ceramic insulator 2 via the sheet packing 28, the ring members 31 and 32, and the talc 33.

Also, a ground electrode 35 is joined to a front end portion 34 of the metallic shell 3. More specifically, a proximal end portion of the ground electrode 35 is welded to the front end portion 34 of the metallic shell 3, and a distal end portion of the ground electrode 35 is bent such that a side surface of the distal end portion faces a front end portion (noble metal tip 41, which will be described later) of the center electrode 5. Additionally, the ground electrode 35 has a 2-layer structure consisting of an outer layer 35A and an inner layer 35B. In the present embodiment, the outer layer 35A is formed of an Ni alloy [e.g., INCONEL 600 or INCONEL 601 (registered trademark)]. The inner layer 35B is formed of a copper alloy or copper, which is superior in heat conduction to the Ni alloy.

Additionally, the circular columnar noble metal tip 41 formed of a noble metal alloy (e.g., a platinum alloy, an iridium alloy, or the like) is joined to the front end surface of the center electrode 5. A spark discharge gap 42 is formed between the front end surface of the noble metal tip 41 and a surface of the ground electrode 35 which faces the noble metal tip 41.

Figure 2:
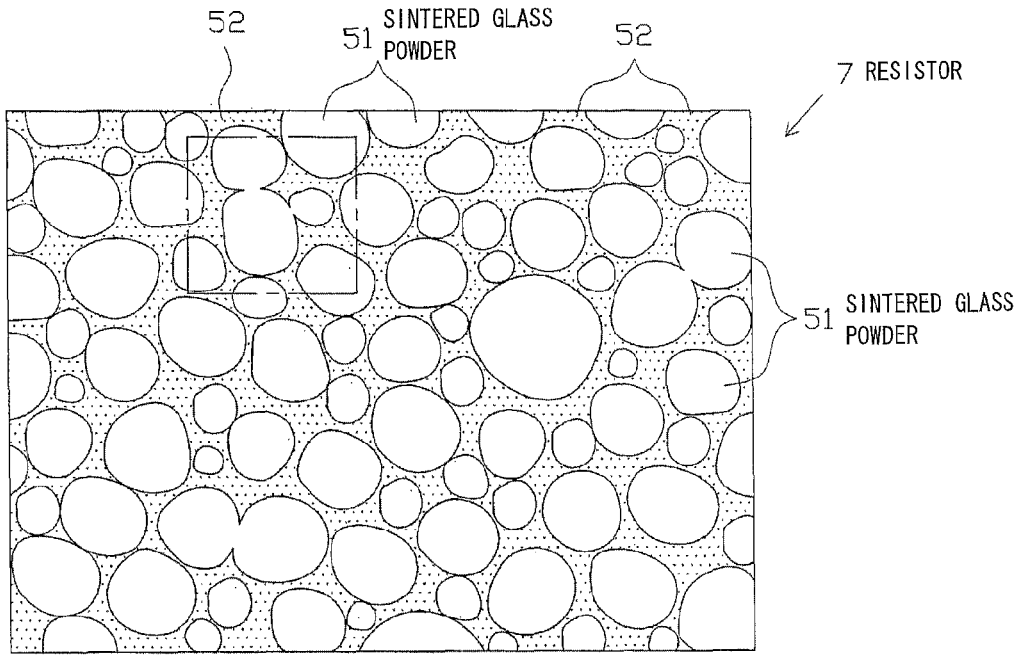
FIG. 2 is an enlarged sectional view showing the shape of particles of sintered glass powder, etc., contained in a resistor.
Figure 3:
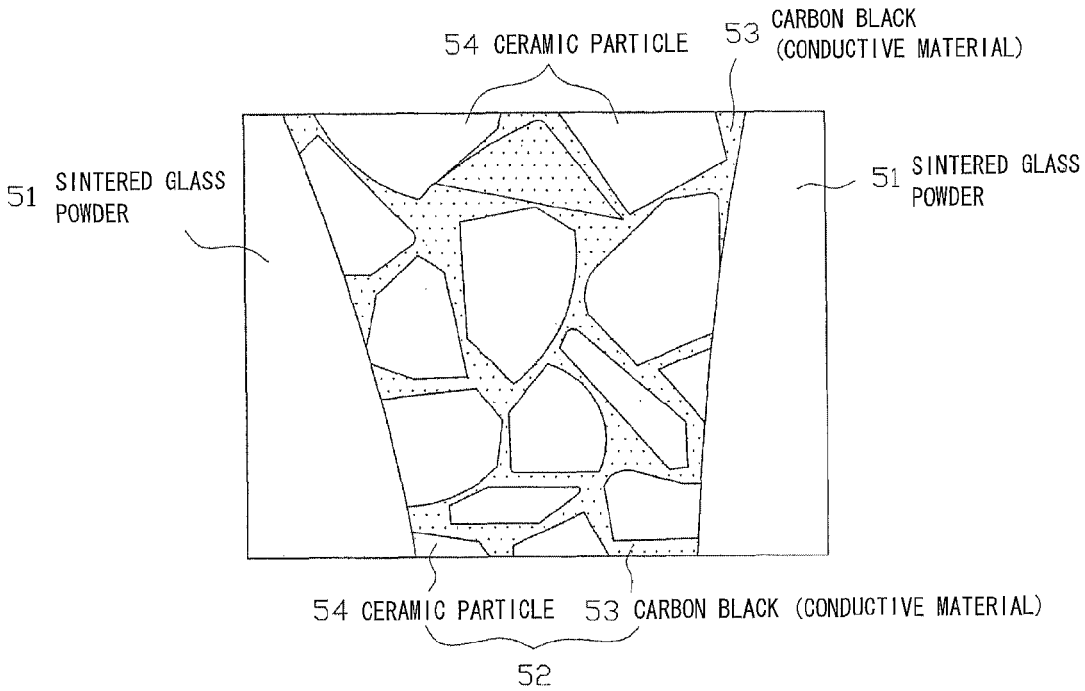
FIG. 3 is a fragmentary, enlarged sectional view showing the configuration of conductive paths.

Next, the resistor 7, by which the present invention is characterized, will be described. In the present embodiment, as shown in FIG. 2 (enlarged sectional view of the resistor 7 taken along a direction orthogonal to the axis CL1), the resistor 7 consists of sintered glass powder 51 formed through sintering of glass powder; i.e., formed through glass powder undergoing heat treatment to be described later, and conductive paths 52 (represented by dotting in FIG. 2), which are disposed in such a manner as to cover particles of the sintered glass powder 51. As shown in FIG. 3, the conductive paths 52 consist of the carbon black 53 (represented by dotting in FIG. 3) and ceramic particles [e.g., zirconium oxide ($ZrO_2$) particles and titanium oxide ($TiO_2$) particles] 54 other than glass. In the present embodiment, the resistor 7 contains the sintered glass powder 51 in an amount of 60% by mass to 90% by mass inclusive (e.g., 80% by mass), the carbon black 53 in an amount of 0.5% by mass to 10% by mass inclusive (e.g., 2% by mass), and the ceramic particles 54 in an amount of 5% by mass to 30% by mass inclusive (e.g., 18% by mass).

The sintered glass powder 51 has a role of densely bonding the resistor 7 to the glass seal layers 8 and 9. Further, in the present embodiment, as viewed on a section of the resistor 7 taken along a direction orthogonal to the axis CL1, 50% or more (e.g., 60%) of the sintered glass powder 51 has a circularity of 0.8 or greater.

Figure 4:
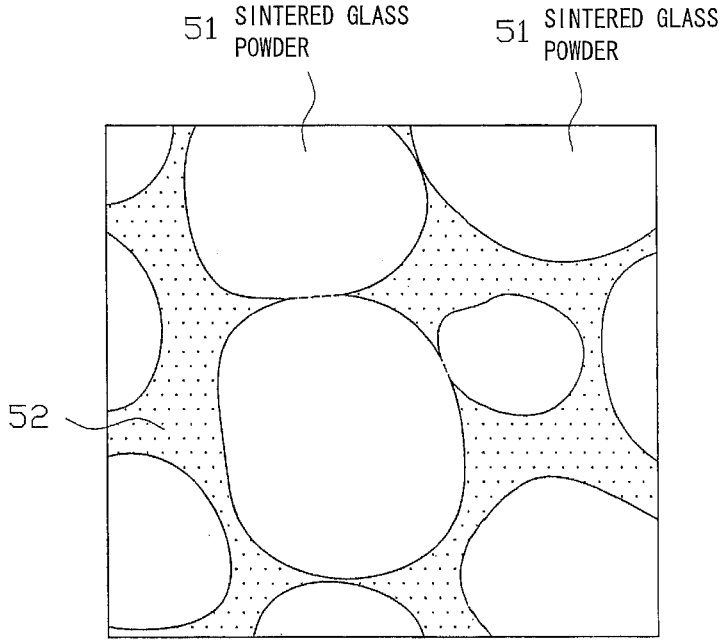
FIG. 4 is an enlarged schematic sectional view for explaining a method of processing fused particles of sintered glass powder in judging the percentage of sintered glass powder having a circularity of 0.8 or greater.

The term "circularity" means a value obtained by dividing the circumference of a circle whose area is equal to the area of a cross section of a particle of the sintered glass powder 51 by the perimeter of the cross section of the particle of the sintered glass powder. Whether or not 50% or more of the sintered glass powder has a circularity of 0.8 or greater is judged, for example, as follows: by use of an SEM (scanning electron microscope), a backscattered electron image of a cross section of the resistor 7 is obtained; and the obtained backscattered electron image is image-processed and analyzed for judgment. Through subjection to heat treatment, particles of the sintered glass powder 51 may be fused together. Thus, whether or not 50% or more of the sintered glass powder has a circularity of 0.8 or greater may be judged with respect to the sintered glass powder 51 remaining after removal of fused particles of the sintered glass powder 51. Alternatively, the judgment may be made as follows: as shown in FIG. 4 (FIG. 4 shows the region surrounded by the dot-dash line in FIG. 2), after a process of separating fused particles of the sintered glass powder 51, whether or not 50% or more of the sintered glass powder has a circularity of 0.8 or greater is judged.

Next, a method of manufacturing the spark plug 1 configured as mentioned above is described. First, the metallic shell 3 is formed beforehand. Specifically, a circular columnar metal material (e.g., an iron-based material, such as S17C or S25C, or a stainless steel material) is subjected to cold forging so as to form a through hole, thereby forming a general shape. Subsequently, machining is conducted so as to adjust the outline, thereby yielding a metallic-shell intermediate.

Subsequently, the ground electrode 35 formed of an Ni alloy or the like is resistance-welded to the front end surface of the metallic-shell intermediate. The resistance welding is accompanied by formation of so-called "sags." After the "sags" are removed, the threaded portion 21 is formed in a predetermined region of the metallic-shell intermediate by rolling. Thus, the metallic shell 3 to which the ground electrode 35 is welded is obtained. The metallic shell 3 to which the ground electrode 35 is welded is subjected to galvanization or nickel plating. In order to enhance corrosion resistance, the plated surface may be further subjected to chromate treatment.

Separately from preparation of the metallic shell 3, the ceramic insulator 2 is formed. For example, a forming material granular-substance is prepared by use of a material powder which contains alumina in a predominant amount, a binder, etc. By use of the prepared forming material granular-substance, a tubular green compact is formed by rubber press forming. The thus-formed green compact is subjected to grinding for shaping. The shaped green compact is placed in a kiln, followed by firing, thereby yielding the ceramic insulator 2.

Separately from preparation of the metallic shell 3 and the insulator 2, the center electrode 5 is formed. Specifically, an Ni alloy prepared such that a copper alloy is disposed in a central portion thereof for enhancing heat radiation is subjected to forging, thereby forming the center electrode 5. The above-mentioned noble metal tip 41 is joined to a front end portion of the center electrode 5 by resistance welding, laser welding, or the like.

Further, a powdery resistor composition used to form the resistor 7 is prepared. More specifically, first, the carbon black 53, the ceramic particles 54, and a predetermined binder are measured out and mixed while water is used as a medium. The resultant slurry is dried. The dried substance is mixed with glass powder formed from a $B_2O_3$—$SiO_2$-based glass material. The resultant mixture is stirred, thereby yielding the resistor composition. The present embodiment uses the glass powder formed such that 50% by mass or more thereof is spherical. Also, the glass powder has an average particle size of 50 μm to 500 μm inclusive (e.g., 50 μm to 200 μm inclusive).

A spherical form can be imparted to the glass powder by use of, for example, the following methods. A high-speed fluid is blown against molten glass, thereby dispersing glass particles, and the dispersed glass particles assume the form of spherical glass powder by the effect of surface tension (refer to, for example, Japanese Patent Application Laid-Open (kokai) No. 552-42512). Alternatively, cullet is mixed with abrasive and grinding aid, and the resultant mixture is kneaded, thereby yielding spherical glass powder (refer to, for example, Japanese Patent Application Laid-Open (kokai) No. H11-228156).

Figure 5:
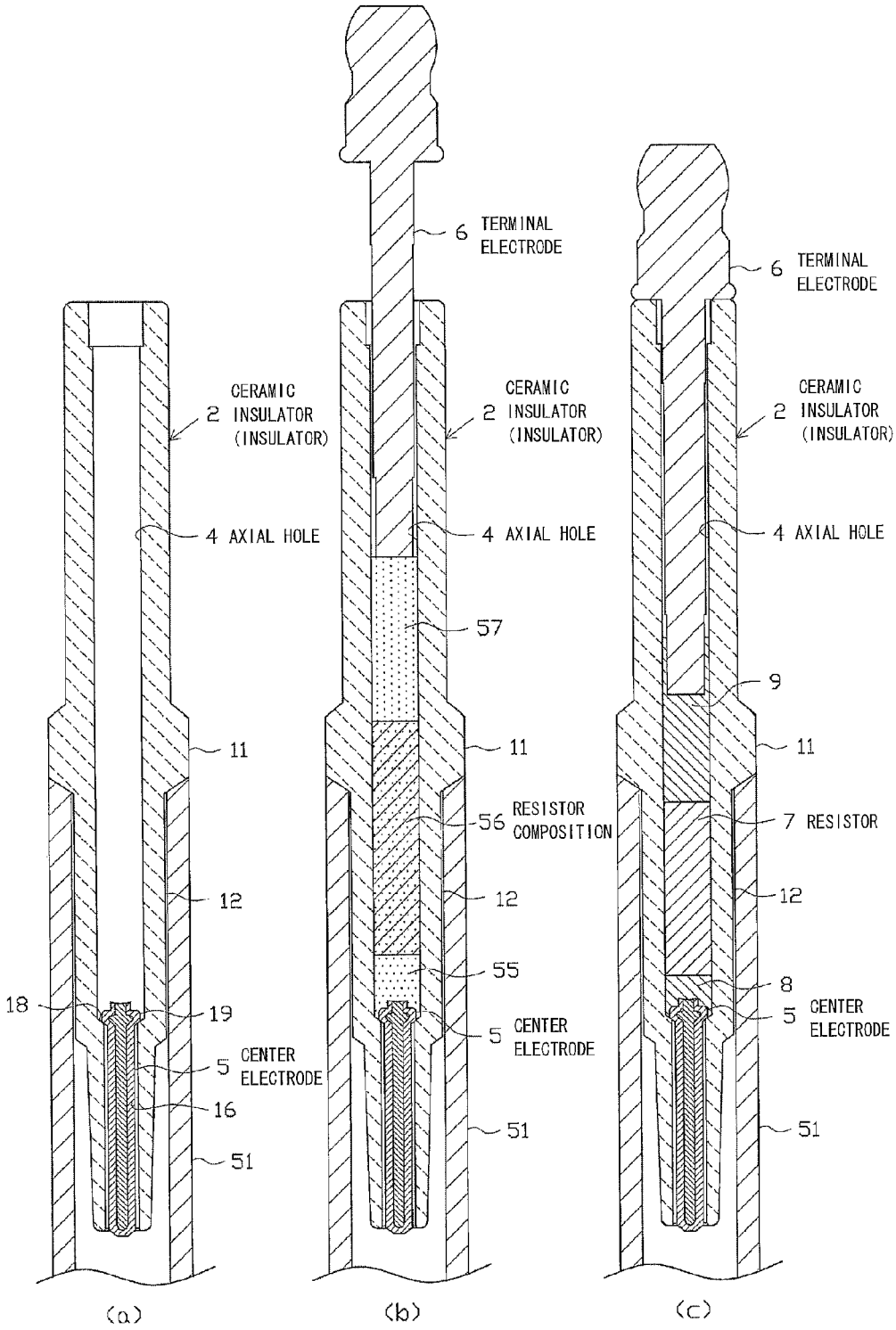
FIGS. 5(*a*) to 5(*c*) are sectional views for explaining a process in the method of manufacturing the spark plug of the present embodiment.

Next, the ceramic insulator 2 and the center electrode 5, which are formed as mentioned above, the resistor 7, and the terminal electrode 6 are fixed in a sealed condition by means of the glass seal layers 8 and 9. More specifically, first, as shown in FIG. 5(*a*), the end surface of a support tube 51 made of metal supports the second stepped portion 15, thereby supporting the ceramic insulator 2. Then, the center electrode 5 is inserted into the small-diameter portion 16 of the axial hole 4. At this time, the expanded portion 19 of the center electrode 5 butts against the stepped portion 18 of the axial hole 4.

Next, as shown in FIG. 5(*b*), conductive glass powder 55, which is generally prepared by mixing borosilicate glass and metal powder, is charged into the axial hole 4. The charged conductive glass powder 55 is preliminarily compressed. Next, a resistor composition 56 is charged into the axial hole 4 and preliminarily compressed in the similar manner. Further, conductive glass powder 57 is charged and also preliminarily compressed. Then, in a state in which the terminal electrode 6 is pressed into the axial hole 4 from the side opposite the center electrode 5, the resultant assembly is heated in a kiln at a predetermined temperature (in the present embodiment, 800° C. to 950° C.) equal to or higher than the softening point of glass.

By this procedure, as shown in FIG. 5(*c*), the resistor composition 56 and the conductive glass powders 55 and 57 in a stacked condition are compressed and sintered, thereby yielding the resistor 7 and the glass seal layers 8 and 9. Also, the ceramic insulator 2 and the center electrode 5, the resistor 7, and the terminal electrode 6 are fixed in a sealed condition by means of the glass seal layers 8 and 9. In this heating process within the kiln, glaze applied to the surface of the rear trunk portion 10 of the ceramic insulator 2 may be simultaneously fired so as to form a glaze layer; alternatively, the glaze layer may be formed beforehand.

Subsequently, the thus-formed ceramic insulator 2 having the center electrode 5, the resistor 7, etc., and the metallic shell 3 having the ground electrode 35 are assembled together. More specifically, a relatively thin-walled rear-end opening portion of the metallic shell 3 is crimped radially inward; i.e., the above-mentioned crimp portion 26 is formed, thereby fixing the ceramic insulator 2 and the metallic shell 3 together.

Finally, the ground electrode 35 is bent so as to form the spark discharge gap 42 between the noble metal tip 41 provided on the front end of the center electrode 5 and the ground electrode 35. Thus, the spark plug 1 is yielded.

As described in detail above, according to the present embodiment, 50% by mass or more of glass powder contained in the resistor composition 56 is spherical. In association with this, as viewed on a section of the resistor 7 taken along a direction orthogonal to the axis CL1, 50% or more of the sintered glass powder 51 has a circularity of 0.8 or greater. Therefore, variation in arrangement of particles of the sintered glass powder 51 in the resistor 7 can be lessened. Thus, great variation among plugs in the quantity, thickness, length, etc., of the conductive paths 52 formed between particles of the sintered glass powder 51 can be restrained to the greatest possible extent. As a result, a predetermined resistance can be more accurately imparted to the resistor 7 with restraint of variation in resistance of the resistor 7 among manufactured spark plugs, whereby yield can be drastically enhanced.

Since the glass powder is specified to have an average particle size of 50 μm or greater, workability can be improved in preparing the resistor composition 56 and in charging the resistor composition 56 into the axial hole 4 of the ceramic insulator 2. Meanwhile, since the glass powder is specified to have an average particle size of 500 μm or less, formation of pores between particles of the sintered glass powder 51 of the resistor 7 can be restrained to the greatest possible extent, whereby the resistor 7 can exhibit sufficient under-load life.

Next, in order to verify actions and effects which the present embodiment yields, a plurality of spark plug samples were fabricated while varying the percentage of sintered glass powder having a circularity of 0.8 or greater as viewed on a section of the resistor taken along a direction perpendicular to the axis by means of varying the mixing ratio between spherical glass powder and crushed glass powder, which constitute the glass powder. The samples were measured for three times the standard deviation of resistance of the resistor (3σ). Permissible differences (tolerances) were determined for resistance of the resistor. The process capability index (Cp) was calculated for each of the tolerances. Evaluation criteria were as follows: when the process capability index (Cp) is 1.67 or greater, evaluation is "excellent;" when the process capability index (Cp) is 1.33 or greater, evaluation is "good;" and when the process capability index (Cp) is less than 1.33, evaluation is "poor." The term "process capability index" means a value obtained by dividing a tolerance by six times the standard deviation (6σ). Table 1 shows, with respect to the samples, the percentage-of-mixing of spherical glass powder contained in the resistor composition, the percentage of sintered glass powder having a circularity of 0.8 or greater as viewed on a section of the resistor, and evaluation for each of the tolerances.

TABLE 1

| Sample No. | No. 1 | No. 2 | No. 3 | No. 4 |
|---|---|---|---|---|
| Percentage-of-mixing of spherical glass powder (% by mass) | 100 | 80 | 50 | 0 |
| Percentage-of-mixing of crushed glass powder (% by mass) | 0 | 20 | 50 | 100 |
| Percentage of sintered glass powder having a circularity of 0.8 or greater (%) | 75 | 64 | 51 | 21 |
| | Evaluation | Evaluation | Evaluation | Evaluation |
| Tolerance: 2 kΩ | Excellent | Excellent | Good | Poor |
| Tolerance: 3 kΩ | Excellent | Excellent | Excellent | Good |
| Tolerance: 4 kΩ | Excellent | Excellent | Excellent | Excellent |

As shown in Table 1, in the case of the samples (samples 1, 2, and 3) in which 50% by mass or more of the glass powder contained in the resistor composition is spherical and 50% or more of the sintered glass powder as viewed on a section of the resistor has a circularity of 0.8 or greater, even for a very small tolerance of 2 kΩ, the process capability index is 1.33 or greater, indicating that a predetermined resistance can be more accurately imparted to the resistor with restraint of variation in resistance of the resistor. Conceivably, this is for the following reason: through employment of a relatively large percentage-of-mixing of the spherical glass powder, variation in arrangement of particles of the sintered glass powder in the resistor can be restrained, thereby restraining great variation among plugs in the quantity, thickness, length, etc., of conductive paths.

Particularly, in the case of the samples (samples 1 and 2) in which 80% by mass or more of the glass powder contained in the resistor composition is spherical and 60% or more of the sintered glass powder as viewed on a section of the resistor has a circularity of 0.8 or greater, even for a tolerance of 2 kΩ, the process capability index is 1.67 or greater, indicating that a predetermined resistance can be far more accurately imparted to the resistor with restraint of variation in resistance of the resistor.

As mentioned above, in view of restraining variation in resistance of the resistor to thereby more accurately impart a certain resistance to the resistor, the following practice is very significant: the resistor is formed by use of the resistor composition containing the glass powder 50% by mass or more of which is spherical; and the resistor is formed such that, as viewed on a section of the resistor taken along a direction perpendicular to the axis, 50% or more of the sintered glass powder has a circularity of 0.8 or greater. In view of further restraining variation in resistance of the resistor, the following practice is very effective: the resistor is formed by use of the resistor composition containing the glass powder 8.0% by mass or more of which is spherical; and the resistor is formed such that, as viewed on a section of the resistor taken along a direction perpendicular to the axis, 60% or more of the sintered glass powder has a circularity of 0.8 or greater.

The present invention is not limited to the above-described embodiment, but may be embodied, for example, as follows. Of course, applications and modifications other than those described below are also possible.

(a) In the embodiment described above, the glass powder is formed of a $B_2O_3$—$SiO_2$-based glass material. However, a material used to form the glass powder is not limited thereto. For example, the glass powder may be form of a material which contains one glass material selected from the group consisting of BaO—$B_2O_3$-based, $SiO_2$—$B_2O_3$—BaO-based, and $SiO_2$—ZnO—$BO_3$-based glass materials.

(b) In the embodiment described above, the noble metal tip 41 is provided at a front end portion of the center electrode 5. A noble metal tip may be provided at a distal end portion of the ground electrode 35 in such a manner as to face the noble metal tip 41 of the center electrode 5. Also, one of the noble metal tip 41 of the center electrode 5 and the noble metal tip of the ground electrode 35 may be eliminated, or both of the noble metal tips may be eliminated.

(c) In the embodiment described above, $ZrO_2$ particles and $TiO_2$ particles are exemplified as the ceramic particles 54. However, other ceramic particles may be used. For example, aluminum oxide ($Al_2O_3$) particles or the like may be used.

(d) In the embodiment described above, the ground electrode 35 is joined to the front end of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(e) In the embodiment described above, the tool engagement portion 25 has a hexagonal cross section. However, the shape of the tool engagement portion 25 is not limited thereto. For example, the tool engagement portion 25 may have a Bi-HEX (modified dodecagonal) shape [ISO22977:2005(E)] or the like.

DESCRIPTION OF REFERENCE NUMERALS

| | |
|---|---|
| 1: | spark plug (spark plug for internal combustion engine) |
| 2: | ceramic insulator (insulator) |
| 3: | metallic shell |
| 4: | axial hole |
| 5: | center electrode |
| 6: | terminal electrode |
| 7: | resistor |
| 51: | sintered glass powder |
| 53: | carbon black (conductive material) |
| 54: | ceramic particle |
| 56: | resistor composition |

The invention claimed is:

1. A spark plug for an internal combustion engine comprising:

a substantially tubular insulator having an axial hole extending therethrough in a direction of an axis;

a center electrode inserted into one end portion of the axial hole;

a terminal electrode inserted into the other end portion of the axial hole;

a substantially tubular metallic shell provided externally of an outer circumference of the insulator; and a resistor formed in the axial hole through sintering of a resistor composition containing a conductive material, glass powder, and ceramic particles other than glass, and electrically connecting the center electrode and the terminal electrode;

characterized in that, as viewed on a section of the resistor taken along a direction orthogonal to the axis, 50% or more of sintered glass powder formed through sintering of the glass powder has a circularity of 0.8 or greater.

2. A spark plug for an internal combustion engine according to claim 1, wherein the sintered glass powder is formed such that 60% or more thereof has a circularity of 0.8 or greater as viewed on the section of the resistor taken along a direction orthogonal to the axis.

3. A spark plug for an internal combustion engine according to claim 1, wherein the sintered glass powder contains one glass material selected from the group consisting of $B_2O_3$—$SiO_2$-based, BaO—$B_2O_3$-based, $SiO_2$—$B_2O_3$—BaO-based, and $SiO_2$—ZnO—$B_2O_3$-based glass materials.

4. A spark plug for an internal combustion engine comprising:

a substantially tubular insulator having an axial hole extending therethrough in a direction of an axis;

a center electrode inserted into one end portion of the axial hole;

terminal electrode inserted into the other end portion of the axial hole;

a substantially tubular metallic shell provided externally of an outer circumference of the insulator; and a resistor formed in the axial hole through sintering of a resistor composition containing a conductive material, glass powder, and ceramic particles other than glass, and electrically connecting the center electrode and the terminal electrode;

the resistor containing the conductive material in an amount of 0.5% by mass to 10% by mass inclusive, glass in an amount of 60% by mass to 90% by mass inclusive, and the ceramic particles in an amount of 5% by mass to 30% by mass inclusive; and the glass powder having an average particle size of 50 μm to 500 μm inclusive;

characterized in that 50% by mass or more of the glass powder contained in the resistor composition is spherical.

5. A spark plug for an internal combustion engine according to claim 4, wherein the glass powder is formed such that 80% by mass or more thereof is spherical.

6. A spark plug for an internal combustion engine according to claim 4, wherein the glass powder has an average particle size of 50 μm to 200 μm inclusive.

7. A spark plug for an internal combustion engine according to claim 4, wherein the glass powder contains one glass material selected from the group consisting of $B_2O_3$—$SiO_2$-based, BaO—$B_2O_3$-based, $SiO_2$—$B_2O_3$—BaO-based, and $SiO_2$—ZnO—$B_2O_3$-based glass materials.

8. A spark plug for an internal combustion engine according to claim 2, wherein the sintered glass powder contains one glass material selected from the group consisting of $B_2O_3$—$SiO_2$-based, BaO—$B_2O_3$-based, $SiO_2$—$B_2O_3$—BaO-based, and $SiO_2$—ZnO—$B_2O_3$-based glass materials.

9. A spark plug for an internal combustion engine according to claim 5, wherein the glass powder has an average particle size of 50 μm to 200 μm inclusive.

10. A spark plug for an internal combustion engine according to claim 5, wherein the glass powder contains one glass material selected from the group consisting of $B_2O_3$—$SiO_2$-based, BaO—$B_2O_3$-based, $SiO_2$—$B_2O_3$—BaO-based, and $SiO_2$—ZnO—$B_2O_3$-based glass materials.

11. A spark plug for an internal combustion engine according to claim 6, wherein the glass powder contains one glass material selected from the group consisting of $B_2O_3$—$SiO_2$-based, BaO—$B_2O_3$-based, $SiO_2$—$B_2O_3$—BaO-based, and $SiO_2$—ZnO—$B_2O_3$-based glass materials.

* * * * *